United States Patent [19]

Ford et al.

[11] 4,403,423

[45] Sep. 13, 1983

[54] DRAFTING INSTRUMENT

[76] Inventors: Alan T. Ford, P.O. Box 531, Green Harbor, Mass. 02041; Norman G. Graf, 225 High St., Hingham, Mass. 02043

[21] Appl. No.: 295,094

[22] Filed: Aug. 21, 1981

Related U.S. Application Data

[63] Continuation-in-part of Ser. No. 73,220, Sep. 7, 1979, abandoned.

[51] Int. Cl.[3] ..... B43L 13/14

[52] U.S. Cl. ..... 33/432; 33/474; 33/482

[58] Field of Search ..... 33/430, 480, 479, 474, 33/438, 432, 449

[56] References Cited

U.S. PATENT DOCUMENTS

| | | | |
|---|---|---|---|
| D. 137,749 | 4/1944 | Murphy | 33/470 X |
| 1,142,368 | 6/1915 | Row | 33/438 |
| 1,723,517 | 8/1929 | McFadden | 33/474 |
| 2,713,205 | 7/1955 | Nielsen | 33/479 |
| 3,279,074 | 10/1966 | McQuaid | 33/480 |
| 3,604,118 | 9/1971 | Miller | 33/474 |
| 3,672,062 | 6/1972 | Baker | 33/449 |
| 4,166,322 | 9/1979 | Hirano | 33/432 |

FOREIGN PATENT DOCUMENTS

| | | | |
|---|---|---|---|
| 1011323 | 6/1957 | Fed. Rep. of Germany | 33/430 |
| 643930 | 9/1950 | United Kingdom | 33/403 |

*Primary Examiner*—Harry N. Haroian

*Attorney, Agent, or Firm*—Morse, Altman & Dacey

[57] ABSTRACT

A drafting instrument is provided for making pictorial drawings, especially axonometric projections. The instrument is in the form of a template which is placed over the drafting surface and may be attached to a drafting machine, straight edge, T-square, or the like. The template is formed with a straight lower edge, perpendicular side edges and a pair of upper edges defining an angle corresponding to the angle of the view to be drawn, i.e. dimetric, trimetric, isometric. The template includes a vertical centerline at the junction of the two upper edges. The margins along each angled upper edge is marked with graduated markings corresponding to the particular angle of the template and parallel to the adjacent angled upper edge. The template also includes a rectangular window or slot extending parallel to the lower edge and provided with graduated markings formed along the edges thereof for use in preparing the views.

2 Claims, 20 Drawing Figures

DRAFTING INSTRUMENT

CROSS-REFERENCE TO RELATED APPLICATION

This is a continuation-in-part of U.S. application Ser. No. 073,220, filed Sept. 7, 1979, now abandoned.

BACKGROUND OF THE INVENTION

1. Field of The Invention

This invention relates generally to drafting instruments and more particularly is directed towards a new and improved drafting instrument for making axonometric views using a template having angular upper edges corresponding to the angles of the view being prepared and graduated markings along the margins thereof.

2. Description of the Prior Art

Axonometric drawings are a form of orthographic projection wherein the three principal faces of an object that is to be illustrated are inclined to the picture plane in such a manner that the three faces are represented in a single view. In practice, axonometric drawings are constructed in one of several different projections such as isometric, dimetric and trimetric, and in preparing such drawings the draftsman customarily will use a drafting machine which must be adjusted to orient the straight edge to the proper angles which define the particular projection being drawn. This is a particularly time consuming task and requires a good deal of experience in order for the draftsman to render a proper axonometric view in the proper projection and to utilize the proper ellipse angle where required. While various tools and guides are available to draftsmen to aid them in constructing axonometric drawings, their use nonetheless is still time consuming and typically a number of different instruments are required to properly develop the view.

Accordingly, it is an object of the present invention to provide a simple drafting instrument for use in quickly and easily making axonometric drawings that are highly accurate and repeatable.

Another object of this invention is to provide a simple, low cost, drafting instrument that may be used independently of or in conjunction with other drafting equipment, such as a drafting machine, for producing accurate high quality axonometric drawings in which the lines are in the exact angular relationship for the particular projection being drawn.

SUMMARY OF THE INVENTION

This invention features a drafting instrument for use primarily in the construction of axonometric drawings, comprising a template formed with straight parallel side edges, a preferably straight lower edge, and a pair of upper edges in the form of a V-notch at an angle and in a position corresponding to the particular projection to be drawn, such as isometric, dimetric and trimetric. Left and right horizontal scales corresponding to the particular projection are provided along the upper margins with the scale lines along one upper margin being parallel to the edge along the other upper margin and with vertical scales provided along the vertical margins. The template is formed with a horizontal slot near the lower edge and provided with a standard scale along the margins thereof. Various means are provided for connecting the template to a drafting machine or the like and for changing the position of the template angularly.

Inverting it provides a means for presenting a "worm's eye view" as opposed to a "bird's eye view" to show features of construction which might otherwise be missed.

BRIEF DESCRIPTION OF THE DRAWINGS

FIG. 16 is a top plan view of the drafting instrument for preparing an isometric view, FIG. 17 is a top plan view of a drafting instrument for preparing a dimetric view, FIG. 18 is a top plan view of a drafting instrument for preparing a trimetric view, and, FIGS. 19 and 20 are top plan views showing two different modifications of the invention.

DETAILED DESCRIPTION OF THE PREFERRED EMBODIMENTS

Figure 1:
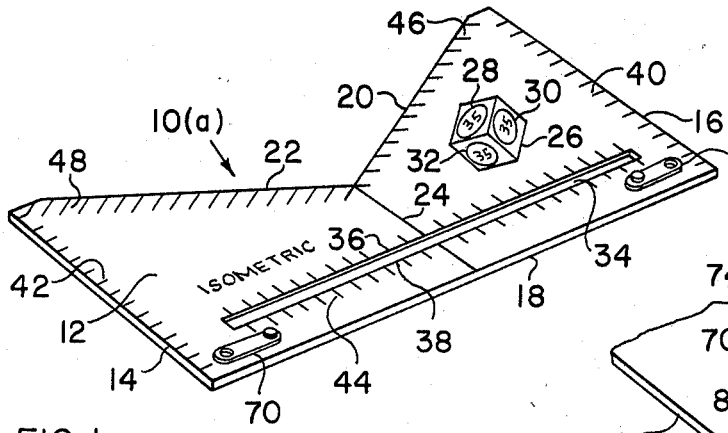
FIG. 1 is a view in perspective of a drafting instrument made according to the invention.
Figure 2:
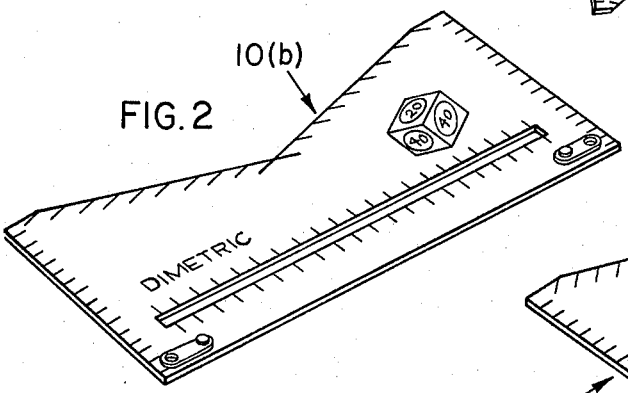
FIGS. 2 and 3 are views similar to FIG. 1 showing similar instruments for use in making different projections.
Figure 3:
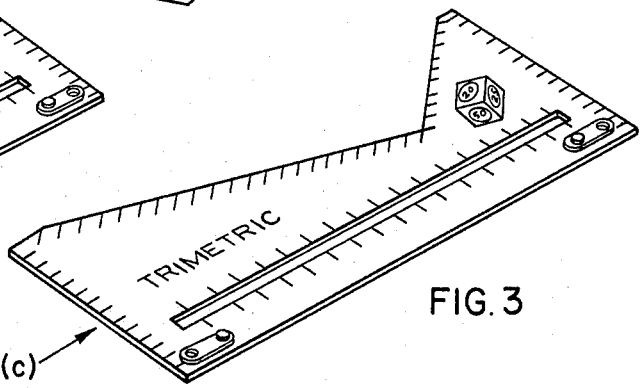

Referring now to the drawings and to FIGS. 1, 2 and 3 in particular, there is illustrated a set of drafting instruments generally indicated by the reference characters 10(A), (B) and (C) and all of similar construction but each configured uniquely for use in rendering different types of axonometric views. The instrument 10(A) of FIG. 1 for example, is for use in preparing isometric views, the instrument 10(B) in FIG. 2 is for use in making dimetric views, while the instrument 10(C) of FIG. 3 is for use in making trimetric views.

Insofar as the instruments of FIG. 1, 2 and 3 are generally similar only one will be described in detail. As shown in FIG. 1, the instrument 10(A) is in the form of a template 12 conveniently fabricated from a flat sheet of rigid or semi rigid material such as various types of plastics, preferably clear and transparent although the instrument may also be fabricated from opaque materials such as steel, aluminum and certain types of opaque rigid plastics. In any event the template is relatively thin and flat and is formed with parallel straight side or vertical edges 14 and 16 and a straight lower or horizontal edge 18 perpendicular to the side edges 14 and 16.

The upper portion of the template is characterized by a right hand edge 20 and a left hand edge 22 at an angle to one another corresponding to the right and left hand horizontal lines of a drawing that is to be constructed in an axonometric projection, the particular angle being determined by the specific projection employed, such as isometric, dimetric or trimetric. A template used for constructing isometric drawings will have right and left hand edges of equal length and defining an angle of 120° therebetween. For a dimetric template the edges 20 and 22 would also be of equal length, but define an angle of 140°. For a trimetric template the edges 20 and 22 are of different lengths and at an angle of 135°. The template may be made up in a variety of different sizes, the most convenient sizes being perhaps those of 6" in overall height and 12" in overall width. Obviously these sizes are only by way of example and templates in a wide variety of different sizes may be made for various applications.

Each of the templates is provided with a vertical reference line 24 serving as a centerline when constructing a drawing and extending vertically downward from the junction of the right and left hand edges 20 and 22. For the isometric and dimetric templates, the centerline 24 will be located in the center of the instrument whereas in the trimetric template, as shown in FIG. 3, the centerline will be offset to one side in the manner shown.

Appearing on the face of each template is a cube 26 rendered according to the particular projection for the template on which it appears. Thus, for the isometric template of FIG. 1, the cube 26 will be an isometric projection, whereas in the dimetric template of FIG. 2, the cube will be dimetric projection and for the trimetric template of FIG. 3, the cube will be in trimetric projection. Each face of the cube is provided with an elipse 28, 30 and 32 appropriately marked for the proper ellipse angle for the particular projection. Thus, the draftsmen in constructing the particular projection, has immediate reference to the proper ellipse angle to be used in that projection.

Formed transversely across the template and parallel with the lower edge thereof is a slot 34 having straight parallel upper and lower edges 36 and 38 which the draftsmen may use when constructing the particular views by providing a pair of horizontal edges for use in making true horizontal lines without shifting to other instruments.

The template is boarded by a number of scales for making accurate measurement when constructing a particular drawing. These scales include a right hand vertical scale 40 along the right hand vertical edge 16, a left hand vertical scale 42 along the left hand vertical edge 14, and a horizontal scale 44 along either or both edges 36 and 38 of the slot 34. The scale 44 is a standard scale and may be in either inches or metric measurement, as desired. Scales 40 and 42 are axonometric projection scales either isometric, dimetric of trimetric depending on the angle configuration of the template. They may be standard (English) measure or metric. Along the right upper edge 20 is a right horizontal scale 46 while along the left hand edge 22 is a left horizontal scale 48. The scales 46 and 48 are isometric scales on the template 12 used for isometric drawings, whereas for the dimetric template the scales 46 and 48 are dimetric scales, and similarly, trimetric scales are used on the template 10(C) of FIG. 3. All distances in the isometric scale are approximately 80% of true size and typically are prepared by placing an ordinary scale at a 45° angle and marking on a second scale where the second scale is at a 30° angle directly below the ordinary scale. Since all three axes of an isometric view are foreshortened equally, actual measure scales may be employed. In this event, the pictorial view obtained is an isometric drawing rather than an isometric projection. The preparation of dimetric and trimetric scales are also prepared by known techniques.

By embodying scales along the upper edges of the template corresponding with the relevant projection for the particular template, no separate instruments are needed by the draftsmen since he can quickly and easily mark off from the template exact measurements on the drawings which measurements are properly scaled to the particular type of projection.

As best shown in FIGS. 16, 17 and 18, it will be noted that the individual scale lines in each of the scales 40 and 42 are at an acute angle relative to their own respective edges but parallel to their adjacent edges. Thus, the scale lines in the right horizontal scale 46 are parallel to the left hand edge 22 while the scale lines in the left horizontal scale 48 are parallel to the right hand edge 20. In an axonometric projection, it is essential that certain lines be maintained in a parallel relationship. The inclusion of the scale lines on one side of the instrument being arranged parallel with the edge on the opposite side of the instrument is extremely helpful to the draftsmen. This not only provides a reference point, but also provides a continuation of that reference point into a reference line by whch the draftsman can detect any deviation from parallelism if such should begin to occur as the drawing progresses.

Figure 4:
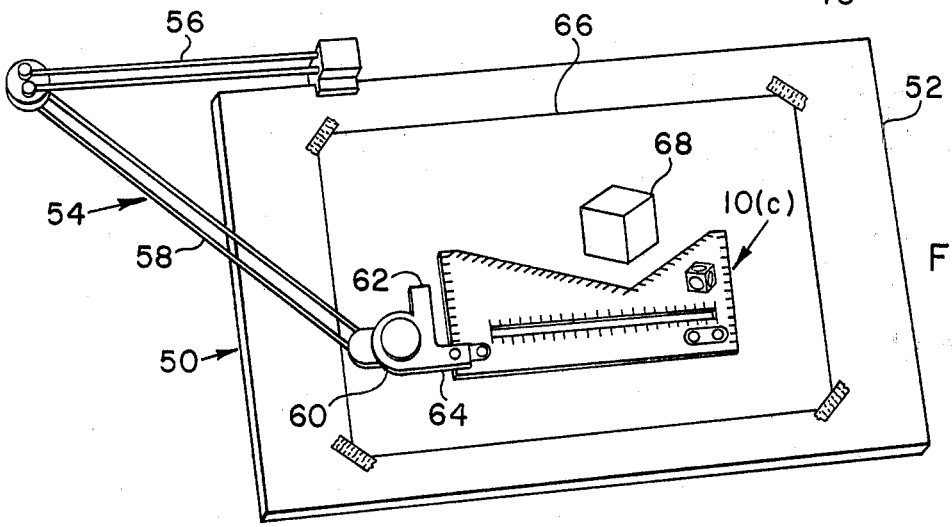
FIG. 4 is a view in perspective showing one of the drafting instruments attached to a drafting machine.
Figure 5:
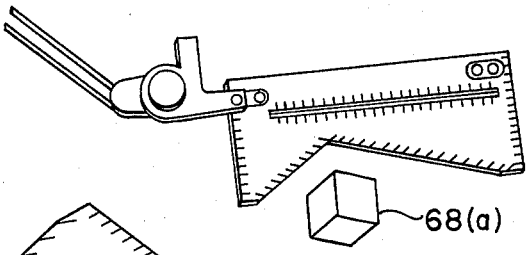
FIG. 5 is a detailed view similar to FIG. 4 but showing the instrument in an inverted position.

Typical use of one of the templates is exemplified in FIGS. 4 and 5 which shows the use of a trimetric template 10(C) in use with a standard drafting machine 50. The machine 10(C) is used with a standard drafting machine 50. The machine 50 typically is used with a drafting board 52 to which it is mounted and includes an arm assembly 54 comprised of articulated upper and lower sections 56 and 58. At the free end of the section 58 is a head 60 provided with perpendicular legs 62 and 64 to either of which a template 10 may be connected. The head may be set to various angles which, once established, will remain at that angle even though the template is moved to various positions over the board. In practice a sheet of drafting material 66 is attached to the face of the board 52 by tacks, tape or the like.

As shown in FIG. 4 an axonometric drawing of a cube 68 has been prepared in trimetric projection using the template 10(C) attached to the leg 64 of the drafting machine.

Figure 6:
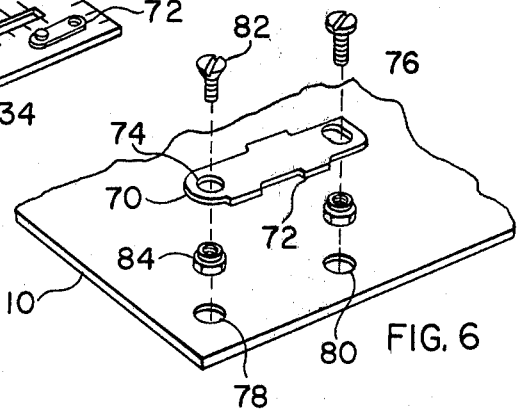
FIG. 6 is a detailed exploded view showing the connector device for use in attaching the instrument to a drafting machine.

Conventional drafting machines are designed to accommodate straight edges sometimes referred to as scales which are provided with connecting devices which detachably attach the scale to a leg of the head 60. Typically, each leg is provided with a socket which locks with a cooperating fitting on the scale. In the illustrated embodiment of FIGS. 1 through 6 each of the templates 10(A), (B) and (C) is provided with a pair of universal chucks 70 and 72, one in each of the lower corners of the template, adapted to lockably engage with a cooperating socket formed in each of the legs 62 and 64 of the drafting machine. Each chuck, as best shown in FIG. 6, is in the form of a plate, preferably of metal, having slightly angled lugs 72 formed along the edges thereof, two on the lower edge and one on the upper edge, as shown. The chuck includes a circular opening 74 at the outer end thereof and a slotted opening 76 at the inner end thereof. The openings are aligned with circular openings 78 and 80 formed in the corners of the template to accommodate nuts and threaded bushings 82, 84 for attaching the chuck to the template. By providing a slot 76 on the inner end, minor angular adjustments may be made to the template when attached to the drafting machine. By providing a pair of connecting clips on the template, the template may be inverted as suggested in FIG. 5 so as to use the edges 20 and 22 to construct an inverted view such as the cube 68 (*a*). In practice, the templates may be quickly changed on the drafting machine by merely disconnecting one template and inserting another, depending upon the particular type of view being constructed.

In preparing the drawing of the cube 68, the template 10(C) is first positioned over the sheet of drafting material at the location where the cube is to be drawn. With the template in the selected position the converging two bottom lines of the cube are drawn in by guiding a drafting pen or pencil along the edges 20 and 22 and measuring the required dimensions along the scales 46 and 48. When this has been done the vertical lines of the cube may be drawn using either of the vertical edges 14 or 16, measuring the required height by the scales 40 and 42. Next the template is moved into position where the center line 24 of the template aligns with the center vertical line of the drawing and the template moved up to draw the forward upper edges of the cube. Next, the template is moved towards the right and the rear edge is added by measuring and drawing along the edge 22. The template is then moved up and to the left and the top edge is added by measuring and drawing along the edge 20. If any ellipses are to be drawn in, the draftsmen merely looks at the reference cube 26 on the template to select the proper ellipse angle for each face of the cube. Obviously far more complex drawings may be prepared than the one illustrated, the cube being shown only by way of example.

Figure 7:
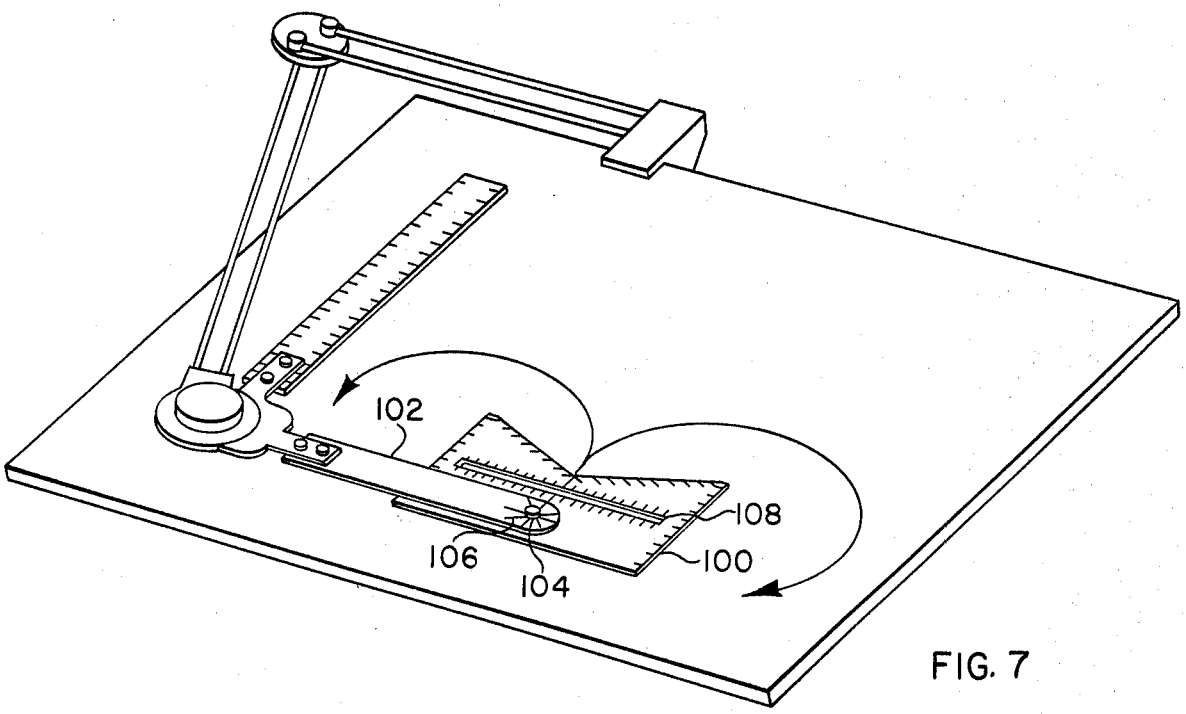
FIG. 7 is a perspective view showing a modification of the invention in use with a drafting machine.

Referring now to FIG. 7 of the drawings, there is illustrated still another modification of the invention and in this embodiment a template 100 is pivotally connected to an extension arm 102 detachably connected to a leg 64 of the drafting machine 50. The template 100 is of a construction similar to the template 10 of the principal embodiment with the exception the template 100 is pivotally connected to the end of the extension arm as by means of a screw 104 passing through the end of the arm in the center of a graduated setting circle 106 and through the centerline of the template, preferably below a horizontal slot 108. In this fashion the template may be rotated to a selected angular position and locked by the screw 104. It is not necessary to detach the template in order to construct different parts of the drawing since the template can be rotated to any desired angular position.

Figure 8:
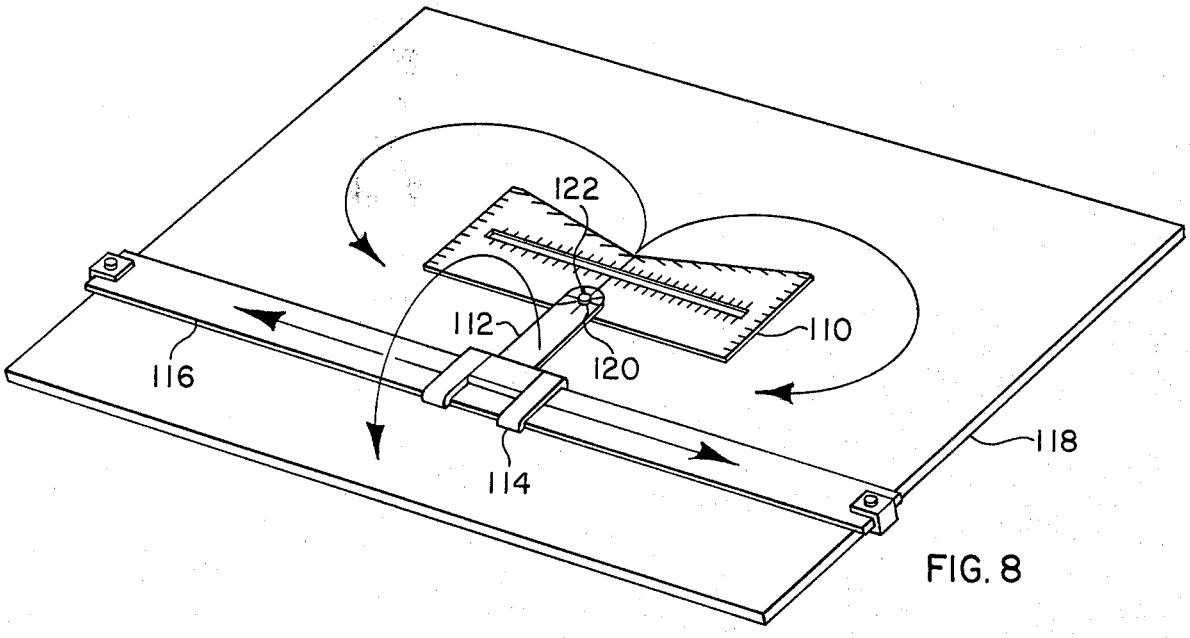
FIG. 8 is a perspective view showing a modification similar to that of FIG. 7 but attached to a straight edge.

Referring now to FIG. 8 of the drawings, there is illustrated a template 110 similar to the template 100 of FIG. 7 and connected to the upper end of an extension are 112 carried by a slide 114 moveable along a straight edge 116. The straight edge 116 is slidably connected at its ends to the side edges of a drafting table 118 whereby the straight edge can be moved up and down over the surface of the table. The extension arm 112 includes a setting circle 120 and a locking screw 122 as in the FIG. 7 embodiment. The extension arm 112 is hinged to the slide 114 by means of which the extension arm and the template may be flipped over to an inverted position when necessary.

Figure 9:
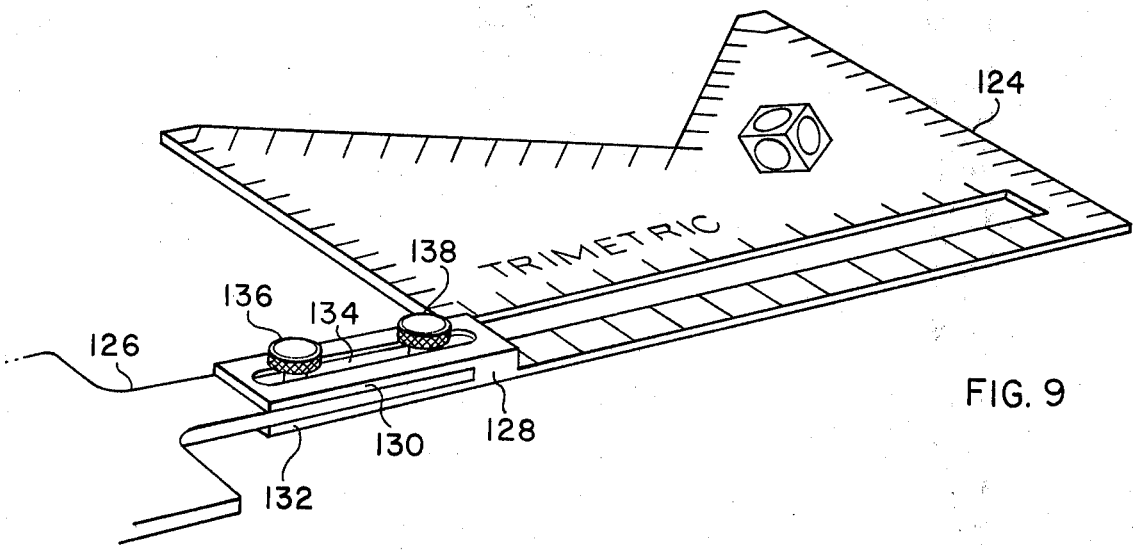
FIG. 9 shows a drafting instrument made according to the invention with a modified connector device.

Referring now to FIG. 9 of the drawings, there is illustrated another modification of the invention and, in this embodiment, a template 124 is provided which is similar to that of the principal embodiment with the exception that the means for detachably connecting the template to a drafting machine leg 126 is by means of a spline member 128 extending laterally from the lower left hand corner of the template. The spline fitting 128 is comprised of upper and lower tongues 130 and 132 formed with longitudinal slots 134 and clamped against the leg 126 by means of screws 136 and 138. The slotted connection allows for limited lateral adjustment of the template. The remaining portion of the template is similar to that of the principal embodiment and may be provided in various forms such as isometric, dimetric and trimetric.

Figure 10:
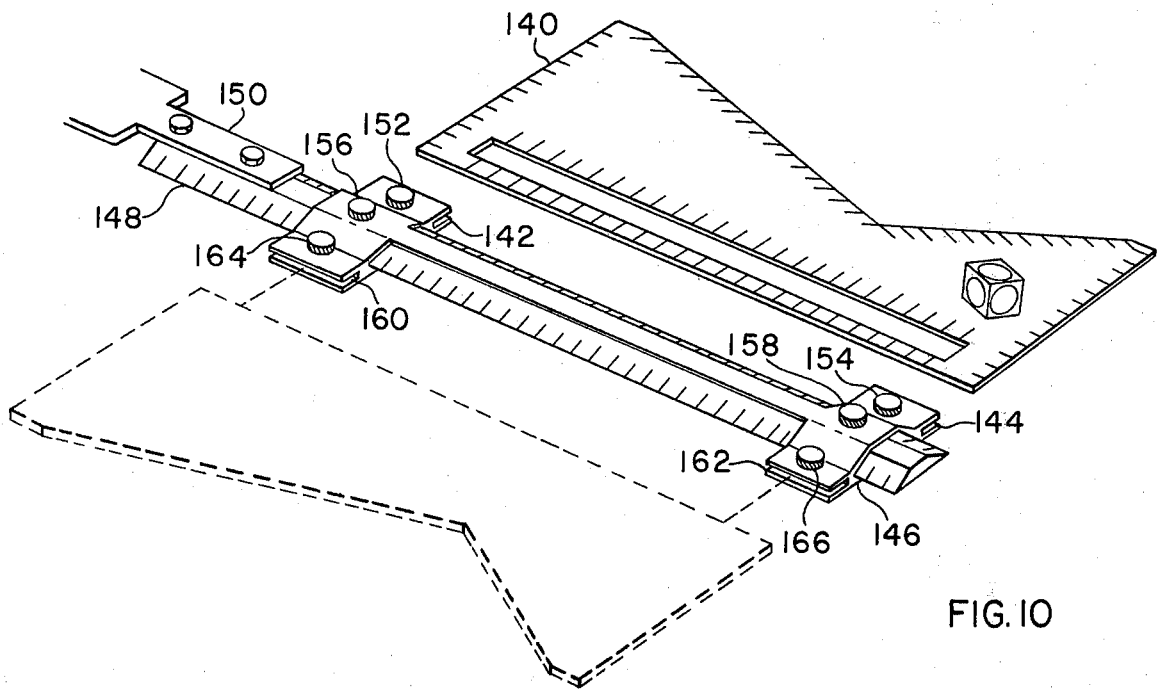
FIG. 10 is a view in perspective showing a modification of the invention.

In the FIG. 10 embodiment a template 140, also similar in construction to that of the principal embodiment, is clamped by its lower edge which is seated in cooperating grooves 142 and 144 formed in a slide 146 mounted to a straight edge scale 148 attached to a leg 150 of a drafting machine. The slide 146 is provided with clamping screws 152 and 154 to grip the template 140 to the slide and clamping screws 156 and 158 are provided to lock the slide at any position along the length of the scale 148. The slide is also provided with grooves 160 and 162 on the opposite side thereof by means of which the template 140 may be detached from the upper side of the slide and set into the grooves 160 and 162 in the manner suggested in dotted line in FIG. 10. Clamping screws 164 and 166 are provided to hold the template in place in this position. Obviously, the template 140 may be in a variety of different sizes and in any one of the different configurations such as isometric, dimetric or trimetric.

Figure 11:
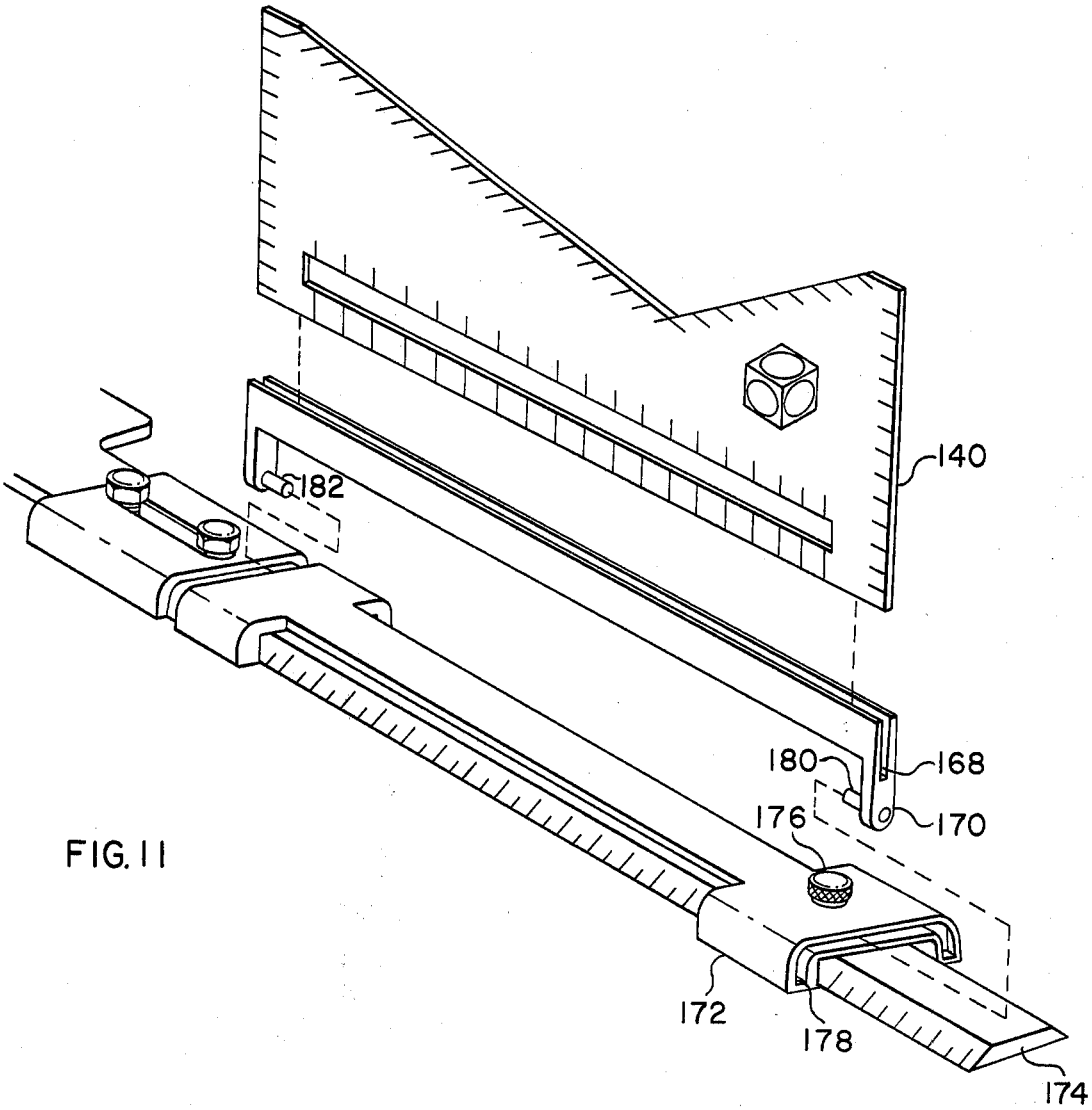
FIG. 11 is a view in perspective showing another modification of the invention.

In the FIG. 11 embodiment the same template 140 of FIG. 10 is mounted in groove 168 formed along the edge of a hinged member 170 carried by a slide 172. The slide 172 is movably mounted along a straight edge scale 174 connected to a leg of the drafting machine, as before. The slide 172 includes a clamping screw 176 for locking the slide in place along the scale and is also formed with outwardly facing arcuate slots 178 at each end thereof to receive inwardly projecting guide pins 180 and 182 on the hinge member 170. With the hinge member 170 mounted to the slide and the template mounted to the hinge member, it is possible to quickly and easily flip the template from one side of the scale 174 to the other with the pins 180 and 182 riding in the grooves 178.

Figure 12:
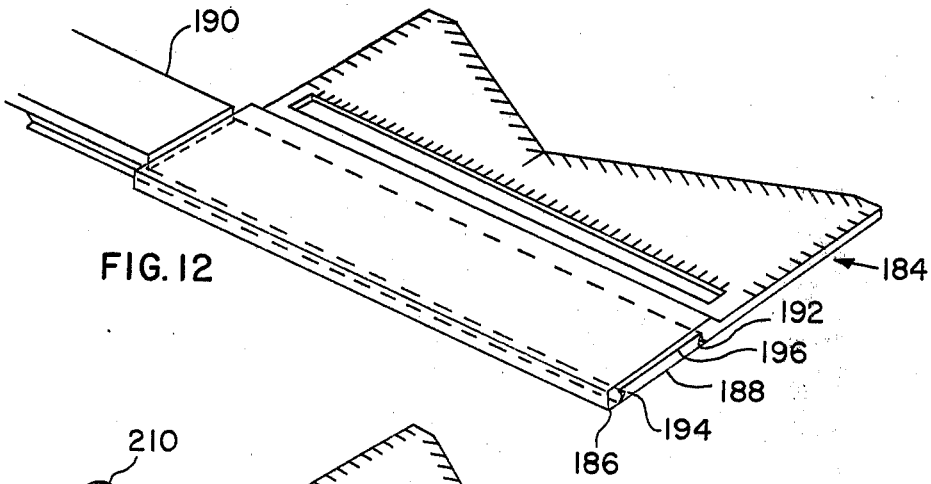
FIG. 12 is a perspective view showing another modification of the invention.

Referring now to FIG. 12 of the drawings, there is illustrated another modification of the invention, and in this embodiment a template 184, similar to the templates in the previous embodiments, is provided with a flange 186 along the lower edge thereof, which flange extends the full width of the lower edge and extends over the top of a flat straight arm 188 attached to the outer end of a drafting machine leg 190. The opposite edges of the arm 188 are formed each with a longitudinal V-notch or groove 192 in which a cooperating rib 194 formed along opposite edges of a recess 196 in the flange 186 provides a sliding spline connection between the template and the arm to allow the template to be selectively moved along the arm, as required.

Figure 13:
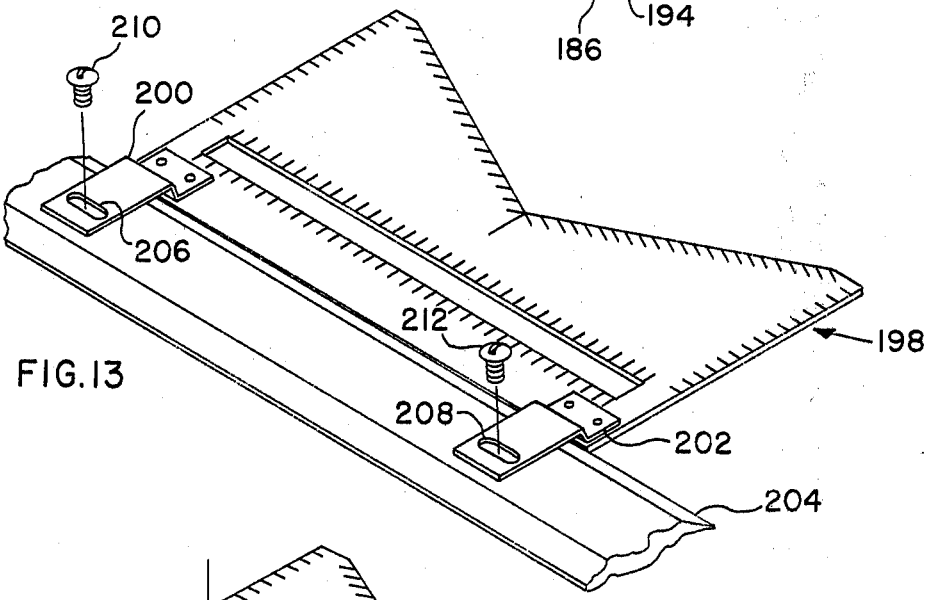
FIGS. 13, 14 and 15 are perspective views showing still other modifications of the invention.

Referring now to FIG. 13 of the drawings, there is illustrated a further modification of the invention, and in this embodiment a template 198 is provided with offset brackets 200 and 202 extending over the top of a straight edge or scale 204 and formed with slots 206 and 208 adapted to receive clamping screws 210 and 212 to mount the template to the straight edge.

Figure 14:
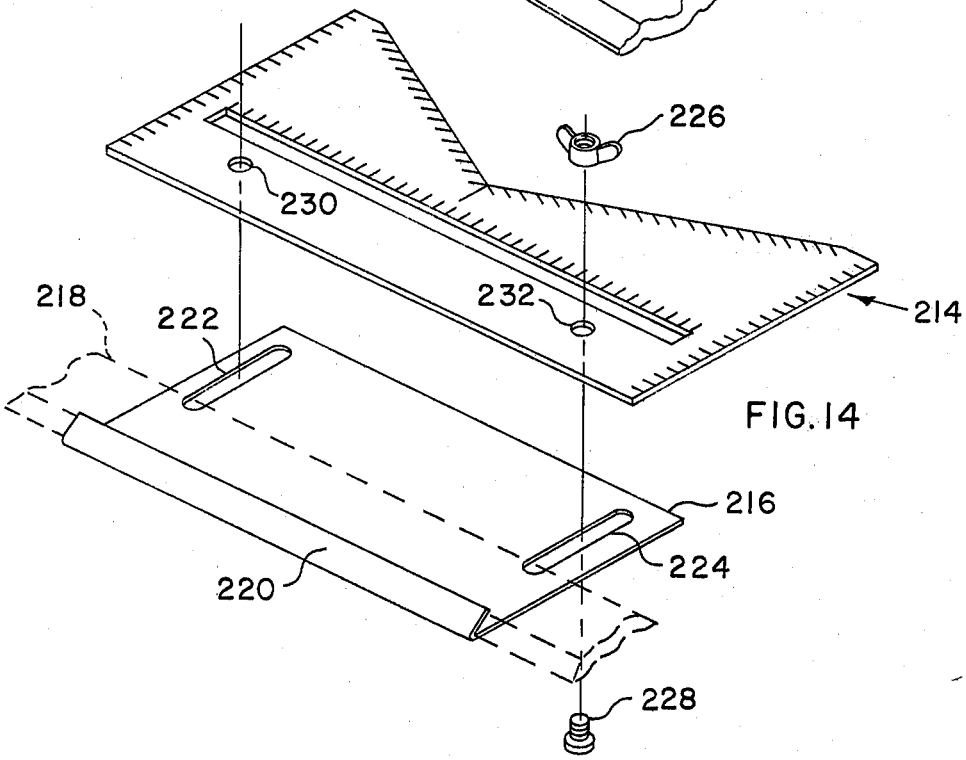

In the embodiment of FIG. 14 a template 214 is provided with a guide plate 216 for slidably connecting the template 214 to a straight edge 218. The guide plate 216 is a rectangular member generally coextensive with the lower portion of the template and formed with a bent flange 220 along the lower edge thereof. Parallel slide slots 223 and 224 receive nuts and screws 226 and 228 extending through circular openings 230 and 232 in the template. The device is used by placing the guide plate under the straight edge 218 with the flange 220 engaging the lower edge of the straight edge. The template is clamped by the screws to the upper portion of the guide plate with the lower edge of the template against the upper edge of the straight edge so that the assembly of the guide plate and template may be slid back and forth along the straight edge.

Figure 15:
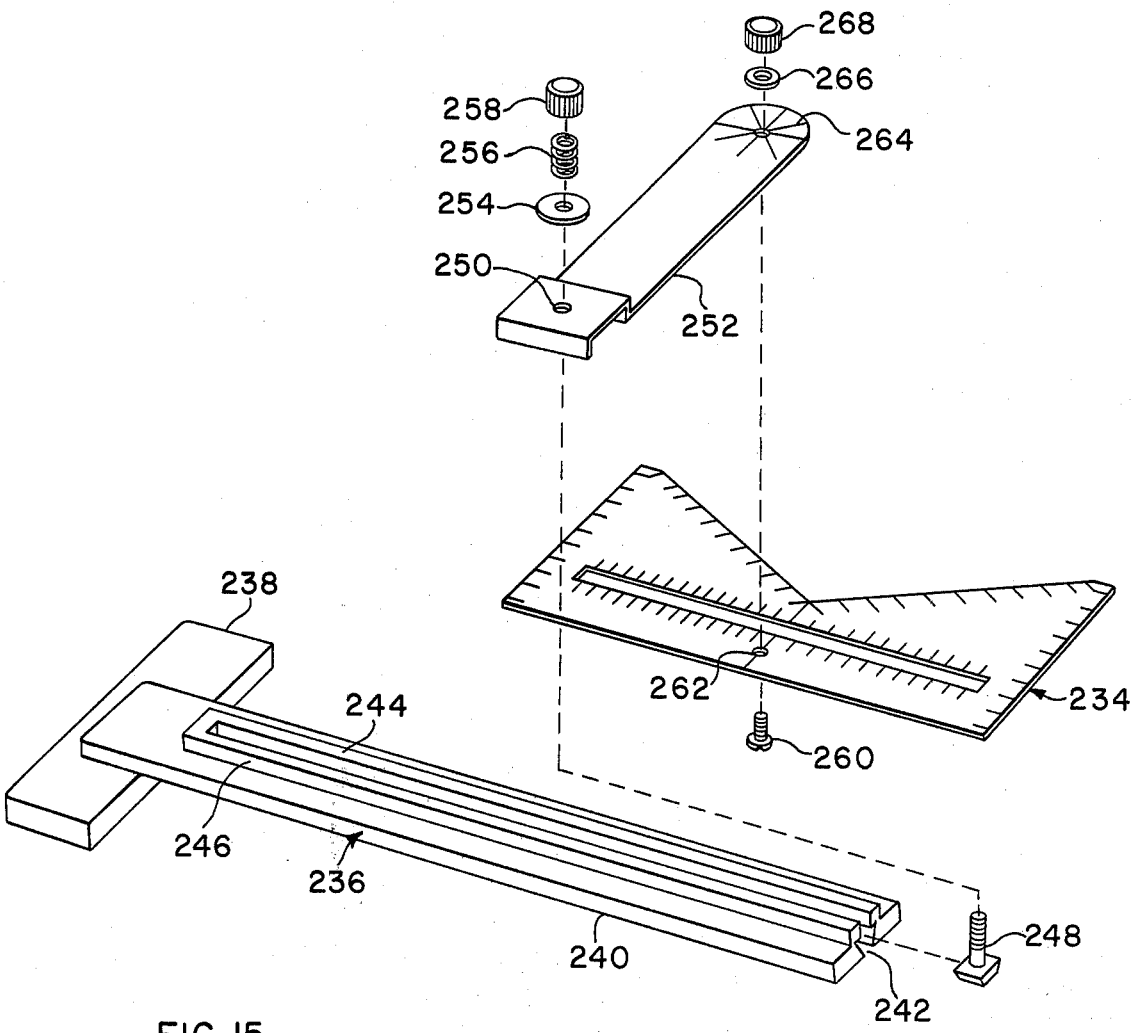

Referring now to FIG. 15, there is illustrated still another modification of this invention, and in this embodiment a template 234 is slidably and rotatably connected to a T-square 236. The T-square is formed with a usual cross piece 238 and a straight leg 240 formed with a longitudinal slot 242 extending substantially the full length thereof. A pair of parallel ribs 244 and 246 extend one along both sides of the top of the slot and define with the slot a guideway for the head of a bolt 248. Preferably the head of the bolt is beveled to conform with similarly contoured faces of the slot 242, as shown. The shank of the bolt extends up through the top of the slot through an opening 250 in the lower end of an extension arm 252. The lower end is formed as a transverse channel piece adapted to fit slidably over the top of the ribs 244 and 246 and to be held in place by an assembly of a washer 254, a spring 256 and a nut 258. Mounted in this fashion the extension arm 252 extends perpendicularly to the length of the leg of the T-square with the template 234 rotatably connected to the upper end of the extension arm by means of a bolt 260 extending through an opening 262 in the template and an opening 264 in the extension arm. A washer 266 and a nut 268 complete the assembly. The upper end of the extension arm is marked in degrees above the opening 264 and the assembly is such that the template may be rotated about the axis of the bolt 260 to any desired angle and the extension arm and template may be slid back and forth along the length of the T-square.

Referring now to FIG. 19, there is illustrated a template 270 that is of rectangular outline and formed with intersecting slots 272 defining edges 224 and 226 inclined to one another at an angle corresponding to the drawing to be made (isometric, dimetric, trimetric). The slots 272 also define upper and lower edges 278 and 280, each with scale lines, serving to draw vertical centerlines on the view to be constructed. It will be noted that the scale markings along the edges 274 and 276 are arranged in the same relationship as the corresponding scale markings of the previous embodiments.

In the embodiment of FIG. 20, a template 282 is somewhat in the form of an inverted Tee and is characterized by an extension 284 formed with a slot 286 defining an inclined edge 288. Another inclined edge 290 is formed along the adjacent side of the template with both inclined edges provided with scale markings arranged as before. The template extension 284 is formed with a leg 292 forming a vertical straight edge 294 disposed along the vertical centerline of the inclined edges to facilitate construction of the drawing.

While the invention has been described with particular reference to the illustrated embodiments, numerous modifications thereto will appear to those skilled in the art.

Having thus described the invention, what we claim and desire to obtain by Letters Patent of the United States is:

1. A drafting instrument for use in making axonometric projections, comprising (a) a generally flat template of a relatively stiff material;

(b) said template being formed with a pair of straight parallel side edges, a straight bottom edge perpendicular to the side edges and a pair of mutually intersecting first and second straight upper edges;

(c) said upper edges extending generally from the side edges of said template downwardly and inwardly to define therebetween an angle corresponding to the angle of a selected axonometric projection;

(d) scale markings corresponding to the selected axonometric projection extending along the margins of said first and second upper and at least one of said side edges, said scale markings along the margins of said upper edges including a plurality of scale lines with the lines along the margin of said first upper edge oriented parallel to the second upper edge and the lines along the margin of said second upper edge oriented parallel to the first upper edge;

(e) said drafting instrument in combination with a slide adapted to be mounted slidably to a straight scale and the like and connecting means operatively associated with said slide and said drafting instrument for connecting one to the other; and (f) wherein said slide includes groove means along at least one side thereof to receive the lower edge of said template inserted therein.

2. A drafting instrument according to claim 1 wherein said slide includes a hinged portion movable from one side to the other of said slide and formed with a groove to receive an edge of said template inserted therein.

* * * * *